US005902074A

United States Patent [19]

Berkley et al.

[11] Patent Number: 5,902,074

[45] Date of Patent: May 11, 1999

[54] APPARATUS AND METHOD FOR STABILIZING SLOPED EMBANKMENTS

[76] Inventors: David M. Berkley; Lorraine F. Berkley, both of 122 Winne Rd., Delmar, N.Y. 12054

[21] Appl. No.: 08/743,198

[22] Filed: Nov. 5, 1996

[51] Int. Cl.[6] ..... E02D 5/02

[52] U.S. Cl. ..... 405/274; 405/284

[58] Field of Search ..... 405/273, 274, 405/275, 276, 277, 278, 279, 280, 281, 283, 284, 285, 286

[56] References Cited

U.S. PATENT DOCUMENTS

| | | | |
|---|---|---|---|
| 836,725 | 11/1906 | Williams | 405/281 |
| 855,030 | 5/1907 | Wemlinger | 405/278 |
| 932,231 | 8/1909 | Zister | 405/281 |
| 1,851,864 | 3/1932 | Nolte | 405/279 |
| 3,999,392 | 12/1976 | Fukushima et al. | 405/281 |
| 4,050,254 | 9/1977 | Meheen et al. . | |
| 4,503,649 | 3/1985 | Sciortino . | |
| 4,707,962 | 11/1987 | Meheen . | |
| 4,917,543 | 4/1990 | Cole et al. | 405/284 X |
| 5,066,353 | 11/1991 | Bourdo . | |
| 5,134,815 | 8/1992 | Pickett . | |
| 5,145,287 | 9/1992 | Hooper et al. . | |
| 5,337,527 | 8/1994 | Wagenaar . | |
| 5,406,745 | 4/1995 | Lin . | |
| 5,456,555 | 10/1995 | Bokeler . | |
| 5,469,655 | 11/1995 | Lin . | |
| 5,499,891 | 3/1996 | Klenert . | |
| 5,536,111 | 7/1996 | Doerneman . | |

FOREIGN PATENT DOCUMENTS

| | | | |
|---|---|---|---|
| 249573 | 3/1926 | United Kingdom | 405/281 |

*Primary Examiner*—Tamara Graysay
*Assistant Examiner*—Frederick Lagman
*Attorney, Agent, or Firm*—Schmeiser, Olsen & Watts

[57] ABSTRACT

An apparatus and method for stabilizing sloped embankments is disclosed which utilizes interlocking barrier elements to form a step-like, cascading barrier to erosion and to provide an inexpensive, easy-to-install and aesthetically attractive landscaping wall, planter or landscaping island. The scallop or channel-like shape of the barrier elements creates filler spaces which may be filled with concrete, soil or other filler materials and in which vegetation may be planted. Each row of barrier elements within the system is locked in place by slip restraint devices which function to prevent vertical slippage of the rows. Adjacent barrier elements on the front most row are held together by frontal locking elements.

13 Claims, 4 Drawing Sheets

FIG. 2
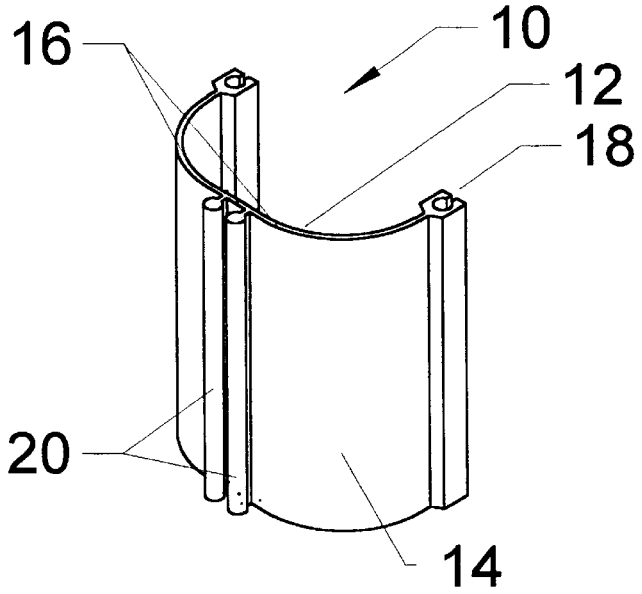
FIG.3
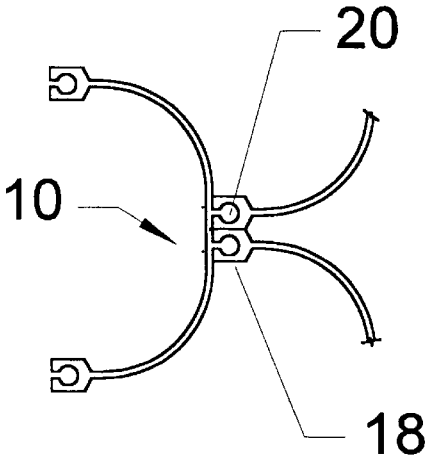
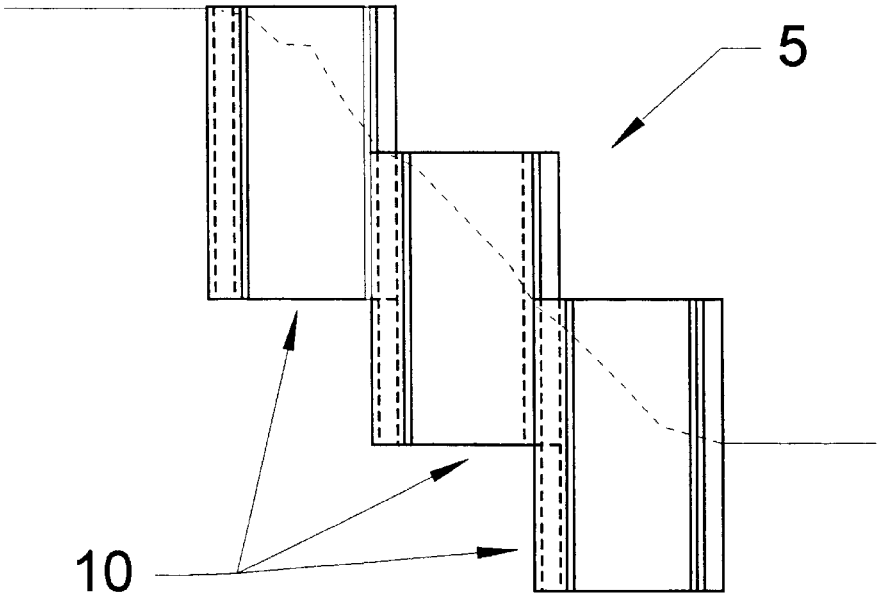
FIG.4

FIG. 5
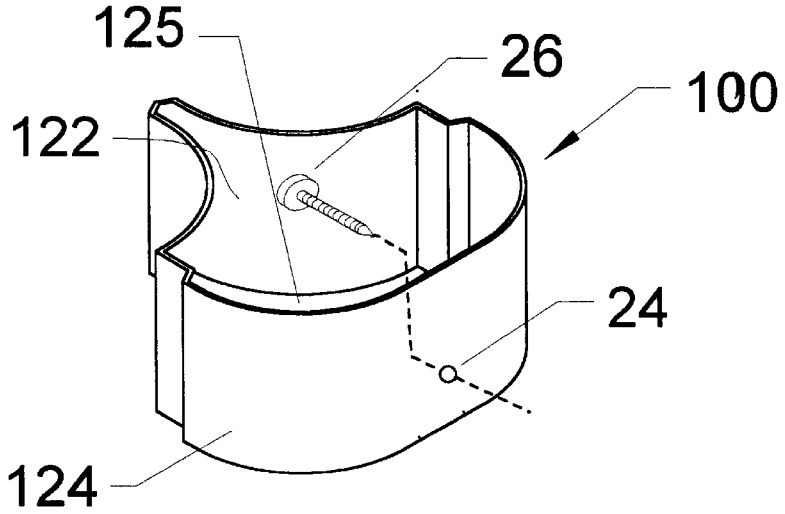
FIG. 6
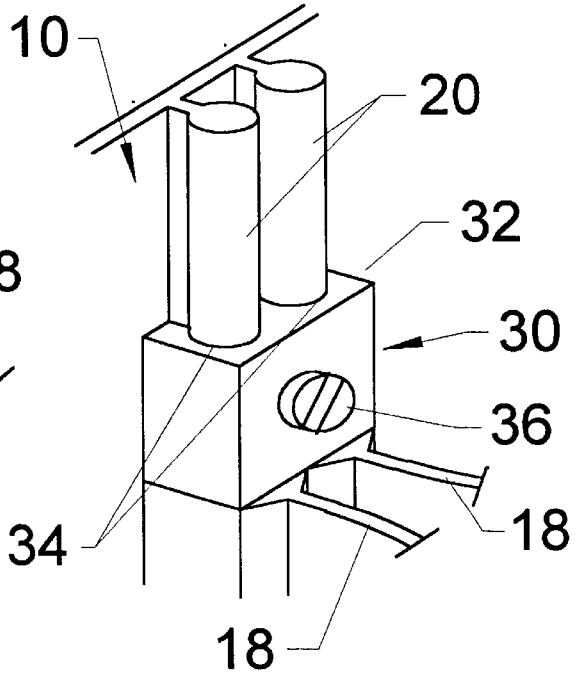
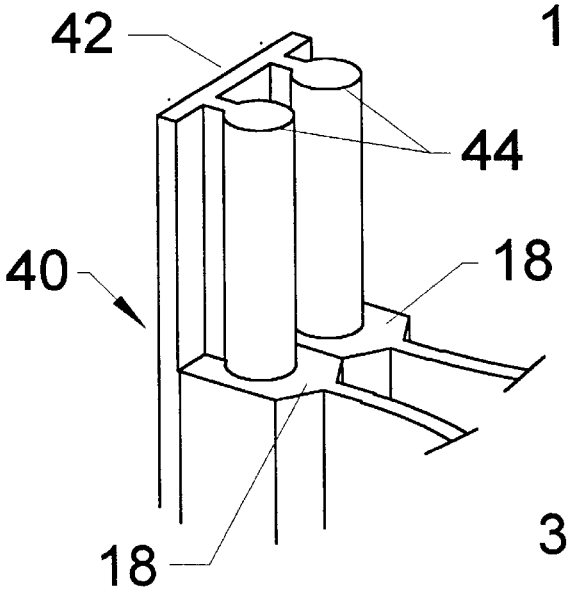
FIG. 7

FIG. 8
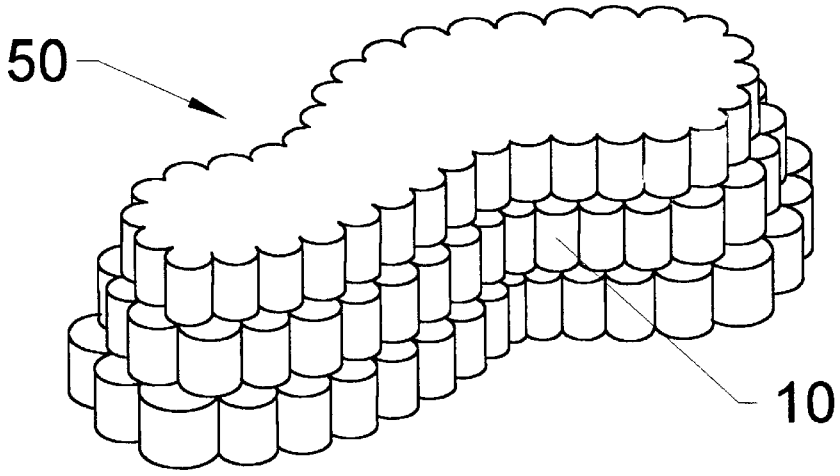
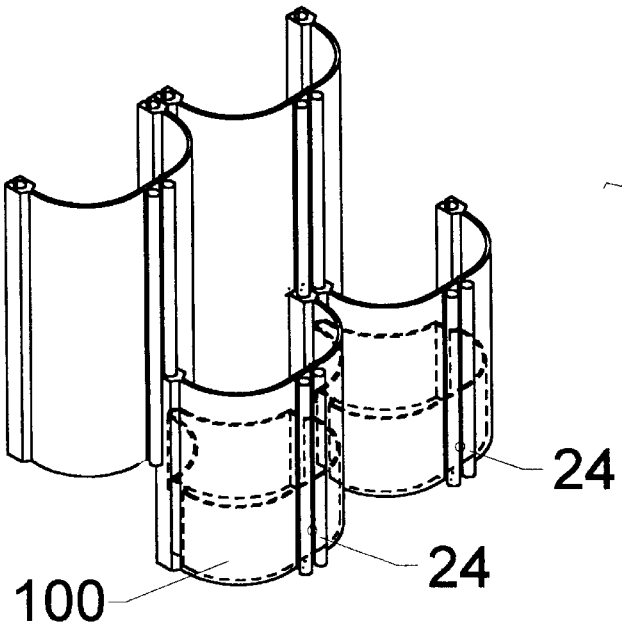
FIG. 10
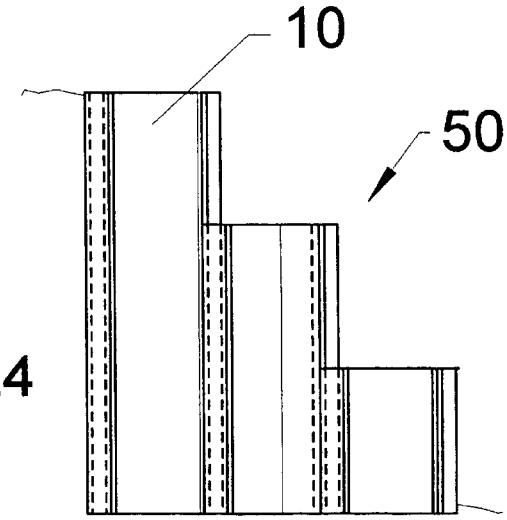
FIG. 9

APPARATUS AND METHOD FOR STABILIZING SLOPED EMBANKMENTS

FIELD OF THE INVENTION

The present invention relates generally to erosion control systems, and more specifically to landscaping barriers and a method for stabilizing sloped embankments.

BACKGROUND OF THE INVENTION

Often when landscaping terrain, it is desirable to create a change in elevation between two distinct land areas using a steep slope or an encompassing embankment. The grade or angle of the slope or embankment rising off a horizontal plain often exceeds the natural angle of repose of the slope or embankment. This makes the slope or embankment susceptible to the erosion or sloughing off of its surface due to its own weight or erosion of its surface by water from rain or irrigation. The instability of a steep slope or embankment surface makes it difficult to maintain. Furthermore, such an unstable surface hinders the growth of stabilizing vegetation.

Typically, stabilization of a steep slope or embankment is accomplished by covering the surface with a structural facing keyed into the toe of the slope. This serves to control sloughing and/or erosion. Another approach has been to replace the slope with a structural retaining wall having a relatively vertical face. However, these types of solutions are often aesthetically displeasing and restrictive to the landscaper because they force the shape of the slope or embankment to conform to the surface shape and texture of the chosen surface protection structure and restrict the growth of vegetation (a natural slope stabilizer) over the surface of the slope or embankment.

Additionally, the above solutions (and others) may require construction skills beyond that of the amateur landscaper; they may be permanent structures requiring continuing costly maintenance; or they may be cost prohibitive due to the manufacturing or construction costs.

A number of devices attempt to resolve the problems associated with stabilizing sloped embankments. Among these are U.S. Pat. No. 4,050,254 to Meheen et al., U.S. Pat. No. 4,503,649 to Sciortino, U.S. Pat. No. 4,707,962 to Meheen, U.S. Pat. No. 5,066,353 to Bourdo, U.S. Pat. No. 5,145,287 to Hooper et al., U.S. Pat. No. 5,134,815 to Pickett, and U.S. Pat. No. 5,536,111 to Doernemann.

U.S. Pat. No. 4,050,254 to Meheen et al. discloses a modular assembled retaining wall which is constructed by founding a plurality of pre-cast tie-back elements in laterally spaced relationship along a grade line. This, however, necessitates considerable reshaping of the embankment because the tie-back means extend vertically back into the embankment, thus requiring either that they be driven back into the soil or that a substantial amount of soil be used to cover each horizontal tier as it is created.

U.S. Pat. No. 4,503,649 to Sciortino discloses premanufactured modular blocks which may interlock to form breakwaters, harbor dams and the like. The modular blocks involve a cylindrical element and a wing arranged substantially at half height of the cylindrical body. The wing is provided with an open cavity arranged to embrace the cylindric element of similar blocks. These modular blocks, however, provide no means whereby vegetation could be grown were they used for stabilizing an embankment.

U.S. Pat. No. 4,707,962 to Meheen discloses a cascade wall structure made up of generally rectangular members with end ribs and curved panels having curved ends which interlock with curved surfaces on the ribs of the members for creating a variety of wall structures for different purposes and uses. These devices, however, are relatively complex and therefore may lack utility for persons not experienced in construction.

U.S. Pat. No. 5,066,353 to Bourdo discloses a shoreline prevention bulkhead system which employs a series of interlocking fiberglass panels. Each panel has elongated male and female interlocking elements extending along the opposite side edges such that, by introducing one end of the male interlocking element of a first panel into an adjacent panel and sliding the interlocking elements together, a secure panel joint is achieved. However, these panels do not allow for any sloping of the embankment.

U.S. Pat. No. 5,145,287 to Hooper et al. discloses plastic panels and a ground erosion barrier made therefrom. The panels are configured in a stretched Z-shape cross sectional design with opposed male and female interlock edges for mating association with adjacent panel strips. As with the Bourdo device described above, this barrier does not allow for any sloping of the embankment.

U.S. Pat. No. 5,134,815 to Pickett discloses a barrier structure including at least one panel disposed to extend generally along a fence line, the panel having an engaging element for pivotal joining of the panel to a member of the structure. Again, like Bourdo and Hooper, using a panel to form a barrier effectively precludes sloping of the embankment.

U.S. Pat. No. 5,536,111 to Doernemann discloses an adjustable erosion control wall including a plurality of individual panels, each panel having a tongue projecting from one end and a groove formed in the opposite end. The panels of the retaining wall are pivotally and vertically slidably connected with the tongue of one panel engaged within the groove of an adjacent panel. This device possesses the same weaknesses as those discussed immediately above.

The above reference summaries are only representative of the elements disclosed in each reference. Each reference should be read individually for what it actually teaches. The references described above are considered pertinent to the disclosure and are hereby incorporated by reference. However, in spite of the existence of these devices for stabilizing embankments, controlling erosion and other similar uses, most of these devices are either too complex or expensive for lay people to implement, or are composed of assemblies of vertical panels, which precludes any sloping of the embankment as might be desirable in various landscaping implementations.

SUMMARY OF THE INVENTION

The present invention effectively stabilizes a slope or embankment without requiring excessive reshaping of the slope or embankment, without precluding a sloping of the embankment, and without the high manufacturing and construction costs associated with many erosion control or stabilization devices. Furthermore, the present invention enables the growth of vegetation on the slope or embankment, which will serve as additional protection against erosion.

This invention involves an apparatus and method for stabilizing sloped soil embankments and the like, for creating terrace planters on sloped embankments, and for creating free-standing soil filled planters or soil filled landscaping islands. The invention utilizes interlocking scallop or channel-shaped devices which interlock in a step-like or cascading fashion to form a barrier which will stabilize a slope. When interlocked in this manner, the devices may be filled with concrete or soil. If soil is used, vegetation may be planted therein to further deter erosion. Because the devices are simple to interlock and are composed of inexpensive materials, they can be obtained and installed with relatively low cost and effort.

This invention includes a method for stabilizing slopes or embankments using a system of interconnected elements of a common shape that will conform to the desired slope or embankment shape in three dimensions.

The barrier devices which, when interconnected to form a barrier, still allow for sloping of the embankment at virtually any desirable angle.

The barrier devices when inner connected form a slope or embankment stabilization system that allows the growth of vegetation throughout the limits of its installation for aesthetic reasons and to take advantage of the natural slope stabilization benefits provided by vegetation's roots.

This invention provides a slope or embankment stabilization system with components of such weights and dimensions that they can be transported and installed by an amateur landscaper, removing the need for special construction equipment or heavy machinery.

This invention includes a slope or embankment stabilization system requiring minimal construction skills, no additional materials beyond the system's few components and an infill material such as the natural soil of the slope or embankment, gravel, or ready mixed concrete, allowing the system to be installed by an individual without outside labor forces if desired.

This invention includes a slope or embankment stabilization system capable of encompassing isolated land areas to create free standing soil filled landscaping islands or smaller soil filled planters.

BRIEF DESCRIPTION OF THE DRAWINGS

These and other advantages of the present invention will become more apparent upon further examination of the drawings wherein:

FIG. 2 is a perspective view of a barrier element in accordance of a preferred embodiment of the present invention;

FIG. 3 is a top plan view of a barrier element in accordance with a preferred embodiment of the present invention depicting its interconnection with two other barrier elements;

FIG. 4 is a side view of a barrier wall of a preferred embodiment of the present invention depicting three interconnected barrier elements in relation to each other and to an embankment;

FIG. 5 is a perspective view of an infill drainage plug;

FIG. 6 is a perspective view of a slip restraint device as applied to one of three interconnecting barrier elements;

FIG. 7 is a perspective view of a frontal locking element in accordance with a preferred embodiment of the present invention;

FIG. 8 is a landscaping island;

FIG. 9 is a side view of a system for stabilizing slopes of a preferred embodiment of the present invention; and FIG. 10 is an infill drainage plug installed in a landscaping scallop.

DETAILED DESCRIPTION OF THE PREFERRED EMBODIMENTS

Figure 1:
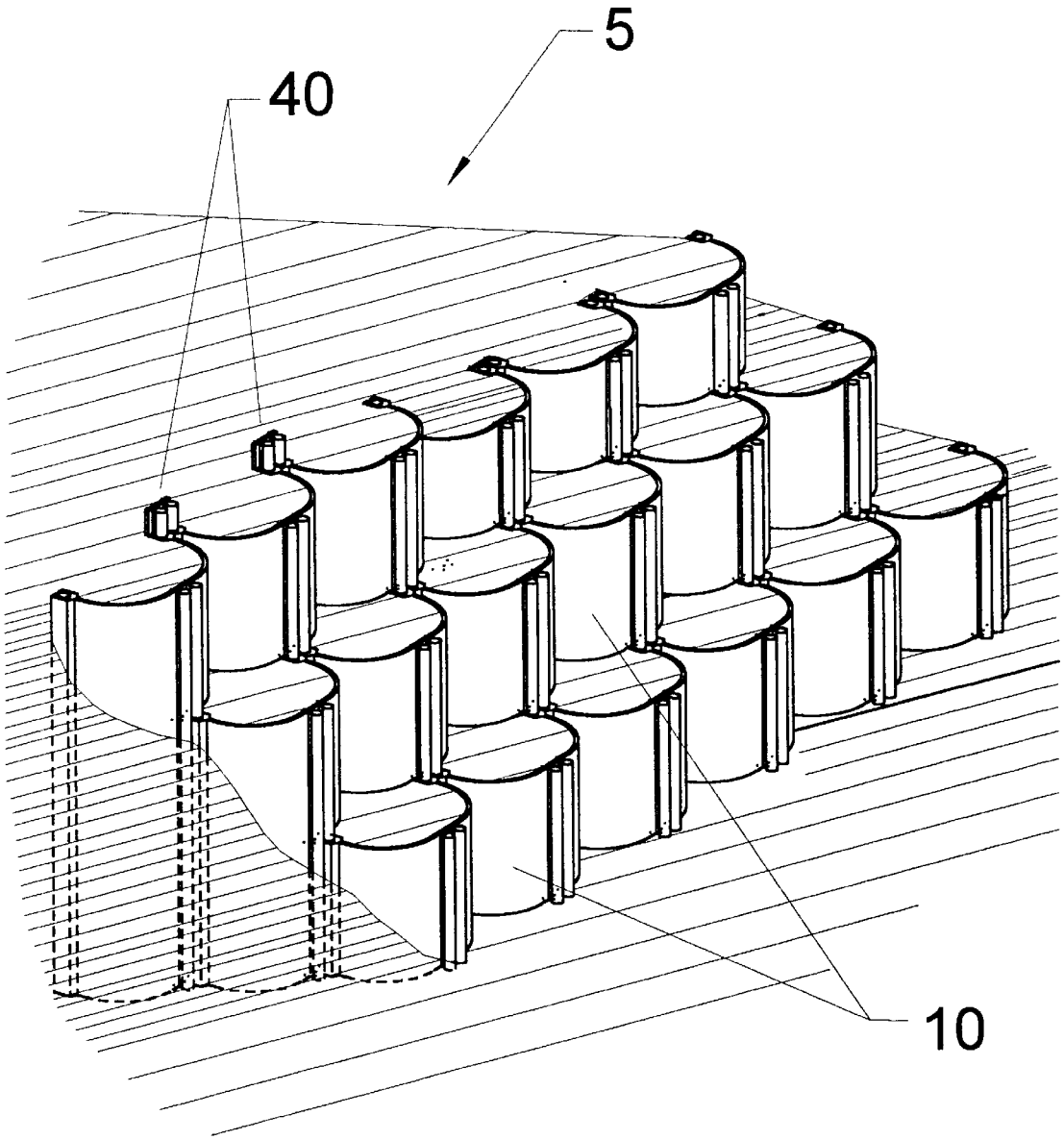
FIG. 1 is a perspective view of a segment of installed barriers in accordance with a preferred embodiment of the present invention.

Referring now to FIG. 1, a perspective view of a barrier wall 5 is shown in accordance with a first preferred embodiment of the present invention. In this embodiment, the barrier elements 10 are scallop, U-shaped or channel shaped and are interconnected in a step-like and cascading fashion to form the barrier wall 5 as shown. Also depicted in FIG. 1 are locking elements 40, which tie together the top-most barrier elements 10. Although this depiction shows three rows of interconnected barrier elements 10, any number of barrier elements 10 may be used in a virtually endless number of combinations to form the desired barrier wall 5.

Referring to FIG. 2, a single barrier element 10 is shown in accordance with a first preferred embodiment of the present invention. Although in this embodiment the barrier element 10 is scallop-shaped, numerous shapes (e.g. triangular, square, etc.) could be utilized while preserving the interlocking function of the barrier element. The element 10 has a concave interior 12 and a convex exterior 14, which combine to form two arms 16, each arm ending with a female connector 18. Two male connectors 20, in this embodiment comprising narrow cylinders, run parallel down the center of the convex exterior 14 of the barrier element 10.

FIG. 3 is a top plan view, showing a barrier element 10 interconnected to the female connectors 18 by means of its male connectors 20. FIG. 4 depicts a side view of a barrier wall 5 with multiple rows of interconnected barrier elements 10. This figure shows the step-like fashion in which barrier elements 10 are arranged in order to create a sloping barrier wall 5.

FIGS. 5 and 10 depict an infill drainage plug 100 which includes filler space 122. The space 122 is bounded by a perimeter wall 124, following the perimeter of the horizontal cross-section of the void between barrier elements 10, and a bottom 125. The filler space 122 is open to the void between barrier elements 10 that exists above the an infill drainage plug 124 which may be in filled with soil, concrete or any other infill material in accordance with an installer's individual preferences.

Also shown in these figures is a fastening means 26 placed in pilot hole 24 and passing into the wall of a barrier element 10 for the purpose of holding the infill drainage plug 100 in place. A barrier wall will normally contain several barrier elements 10 with fill drainage plugs 100 which will be at the bottom of each void created between barrier elements 10 retaining infill material.

FIG. 6 depicts a slip restraint device 30. This device comprises a main body 32, two female connectors 34 which interconnect with the male connectors of the barrier elements 10 and a fastening means 36. The slip restraint device 30 is interconnected with both male connectors 20 of a barrier element 10 after a female connector 18 of two other barrier elements 10 are interconnected to those male connectors 18. The slip restraint device 30 is pushed down flush against the top of the female connectors 18 and tightened using the fastening means 36. In this position, the slip restraint device 30 will prevent vertical slippage and thus maintain the shape of the barrier wall 5.

FIG. 7 is a perspective view of a frontal locking element 40. A frontal locking element 40 is comprised of a main body 42 and two male connectors 44. These male connectors 44 interlock with female connectors 18 of two adjacent barrier elements 10, thus locking together the foremost row of barrier elements 10.

FIG. 8 shows a possible arrangement of barrier elements 10 to form a planter or landscaping island 50 which can be assembled in a variety of sizes and shapes to accommodate individual tastes. FIG. 9 is a cross sectional depiction of the planter or landscaping island 50 of FIG. 8, showing how varying sizes of barrier elements 10 may effectively be used in forming a planter or landscaping island 50.

The foregoing description of the preferred embodiments of this invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

What is claimed is:

1. A barrier element comprising:

a generally arcuate body having a concave interior surface and a convex exterior surface intermediate its ends;

a first and second connector positioned on the ends of the generally arcuate body;

a third and fourth connector positioned adjacent one another on the convex exterior surface of the generally arcuate body; and wherein the first and second connectors of a barrier element are each operatively couplable to one of a third and a fourth connector of another barrier element.

2. The barrier element of claim 1, wherein at least two of said connectors are parallel cylinders and the other two of said connectors are cylindrical bores.

3. The barrier element of claim 1, wherein said barrier element is scallop shaped.

4. The barrier element of claim 2, wherein said barrier element is scallop shaped.

5. The barrier element of claim 4, further comprising at least one slip restraint device having two female elements and means for securing said slip restraint device to interlocking barrier elements.

6. The barrier element of claim 1, further comprising an infill drainage plug having the shape of a void created between interlocking barrier elements.

7. The barrier element of claim 6, further comprising a means for fastening, said infill drainage plug in place at a base of the void created between interlocking barrier elements.

8. A wall system comprising;

a plurality of rows, each row including a plurality of barrier elements in accordance with claim 1.

9. A method for stabilizing a slope or embankment comprising the steps of:

providing a plurality of barrier elements, each barrier element having a concave interior surface, a convex exterior surface, and having means for interlocking with other barrier elements;

providing at least one slip restraint device;

providing at least one locking element;

forming a series of tiered rows having a first and at least a second row by interconnecting said barrier elements;

attaching said at least one slip restraint device to said convex exterior surface of said barrier elements; and attaching said at least one locking element to said means for interlocking said barrier elements.

10. The method of claim 9, wherein the step of interconnecting said barrier elements further comprises connecting female interlocking means on said concave interior surface of a barrier element with male interlocking means on said convex exterior surface of another barrier element.

11. The method of claim 9 wherein the step of attaching said at least one slip restraint device to said convex exterior surface of said barrier elements further comprises attaching said restraint device to said male interlocking means on said convex exterior surface of said barrier elements.

12. The method of claim 9, wherein the step of attaching said at least one slip restraint device further comprises using a screw to tighten said at least one slip restraint device in place, thereby preventing vertical slippage of said male and female interlocking means.

13. The method of claim 12, wherein the step of attaching said at least one frontal locking element to said interlocking means of said barrier elements further comprises attaching said frontal locking element to said female interlocking means of a first row of said series of tiered rows.

* * * * *